US005935012A

United States Patent [19]

Cohn et al.

[11] Patent Number: 5,935,012

[45] Date of Patent: Aug. 10, 1999

[54] WHEELED CHILD SEAT WITH TRACK

[76] Inventors: Irv Cohn; William Highfield, both of 142 Heritage Dr., Ephrata, Pa. 17522

[21] Appl. No.: 09/150,585

[22] Filed: Sep. 10, 1998

[51] Int. Cl.[6] ..... A63G 1/34

[52] U.S. Cl. ..... 472/43; 472/29; 104/53

[58] Field of Search ..... 472/36, 43, 29; 104/53; 238/10 R, 10 A, 10 E, 10 F

[56] References Cited

U.S. PATENT DOCUMENTS 221,817 11/1879 Heyn ..... 238/10 R
1,555,028 9/1925 Roth ..... 472/29 X
5,463,961 11/1995 Graves ..... 104/53
5,487,705 1/1996 Clarke ..... 472/29

*Primary Examiner*—Kien T. Nguyen

[57] ABSTRACT

A wheeled child seat is provided including a seat having a bottom, a back integrally coupled to the bottom and extending upwardly therefrom. A harness is provided for securing a child within the seat. Also included is a drive assembly having wheels mounted on the seat, a plurality of batteries mounted on the seat, and a motor coupled to the seat and in communication with the wheels for rotating the same upon actuation.

7 Claims, 2 Drawing Sheets

WHEELED CHILD SEAT WITH TRACK

BACKGROUND OF THE INVENTION

1. Field of the Invention

The present invention relates to child play seats and more particularly pertains to a new wheeled child seat with track for moving a child in order to facilitate sleeping or resting.

2. Description of the Prior Art

The use of child play seats is known in the prior art. More specifically, child play seats heretofore devised and utilized are known to consist basically of familiar, expected and obvious structural configurations, notwithstanding the myriad of designs encompassed by the crowded prior art which have been developed for the fulfillment of countless objectives and requirements.

Known prior art child play seats include U.S. Pat. No. 4,357,877; U.S. Pat. No. 5,050,504; U.S. Pat. No. 4,537,577; U.S. Pat. No. 4,417,523; U.S. Pat. No. 4,837,876; and U.S. Pat. Des. 356,690.

In these respects, the wheeled child seat with track according to the present invention substantially departs from the conventional concepts and designs of the prior art, and in so doing provides an apparatus primarily developed for the purpose of moving a child in order to facilitate sleeping or resting.

SUMMARY OF THE INVENTION

In view of the foregoing disadvantages inherent in the known types of child play seats now present in the prior art, the present invention provides a new wheeled child seat with track construction wherein the same can be utilized for moving a child in order to facilitate sleeping or resting.

The general purpose of the present invention, which will be described subsequently in greater detail, is to provide a new wheeled child seat with track apparatus and method which has many of the advantages of the child play seats mentioned heretofore and many novel features that result in a new wheeled child seat with track which is not anticipated, rendered obvious, suggested, or even implied by any of the prior art child play seats, either alone or in any combination thereof.

To attain this, the present invention generally comprises a child seat constructed from a plastic material. The seat includes a bottom and a back integrally coupled to the bottom and extending upwardly and rearwardly therefrom. A pair of peripheral lips are each integrally coupled along side edges of the bottom and back and extended upwardly and outwardly therefrom in perpendicular relationship therewith. A pad lines an upper surface of the bottom, the back and an inner surface of the peripheral lips of the seat. As shown in FIG. 1, a Y-shaped harness is provided including a pair of upper ends coupled to a top edge of the back of the seat. A lower end of the harness is equipped with a male locking tab for being releasably received within a female slot of a locking mechanism. Such locking mechanism is mounted on a central extent of a front edge of the bottom of the seat. With reference now to FIG. 3, a drive assembly includes a pair of axles mounted on a lower surface of the bottom of the seat. Each axle has a pair of disk-shaped wheels coupled to its ends. A motor is coupled to the lower surface of the bottom of the seat and remains in engagement with a rear one of the axles for rotating the wheels upon actuation. FIG. 4 shows a power switch mounted on the seat which is connected between the batteries and the motor. In a first orientation, the power switch serves for actuating the motor. The power switch further deactivates the motor when in a second orientation. Situated adjacent to the power switch is a direction switch that is adapted for rotating the wheels in a first direction when the direction switch is in a first orientation and the motor is actuated. The direction switch is further adapted for rotating the wheels in a second direction when the direction switch is in a second orientation and the motor is actuated. Further included is a sound generating assembly having a pair of speakers each coupled to an upper end of one of the peripheral lips of the seat. Connected to the speakers is a sound module for emitting sound from the speakers only during the actuation of the motor. Finally, a track includes a pair of rails interconnected by cross members, as shown in FIG. 1. The track includes a pair of parallel linear portions interconnected by way of a pair of semicircular portions, thereby defining an oval configuration. The rails of the track each have a top face with a recess formed therein for receiving the wheels of the drive assembly to maintain the wheels of the drive assembly of the seat on the track.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new wheeled child seat with track apparatus and method which has many of the advantages of the child play seats mentioned heretofore and many novel features that result in a new wheeled child seat with track which is not anticipated, rendered obvious, suggested, or even implied by any of the prior art child play seats, either alone or in any combination thereof.

It is another object of the present invention to provide a new wheeled child seat with track which may be easily and efficiently manufactured and marketed.

It is a further object of the present invention to provide a new wheeled child seat with track which is of a durable and reliable construction.

An even further object of the present invention is to provide a new wheeled child seat with track which is susceptible of a low cost of manufacture with regard to both materials and labor, and which accordingly is then susceptible of low prices of sale to the consuming public, thereby making such wheeled child seat with track economically available to the buying public.

Still yet another object of the present invention is to provide a new wheeled child seat with track which provides in the apparatuses and methods of the prior art some of the advantages thereof, while simultaneously overcoming some of the disadvantages normally associated therewith.

Still another object of the present invention is to provide a new wheeled child seat with track for moving a child in order to facilitate sleeping or resting.

Even still another object of the present invention is to provide a new wheeled child seat with track that includes a seat having a bottom, a back integrally coupled to the bottom and extending upwardly therefrom. A harness is provided for securing a child within the seat. Also included is a drive assembly having wheels mounted on the seat, a plurality of batteries mounted on the seat, and a motor coupled to the seat and in communication with the wheels for rotating the same upon actuation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
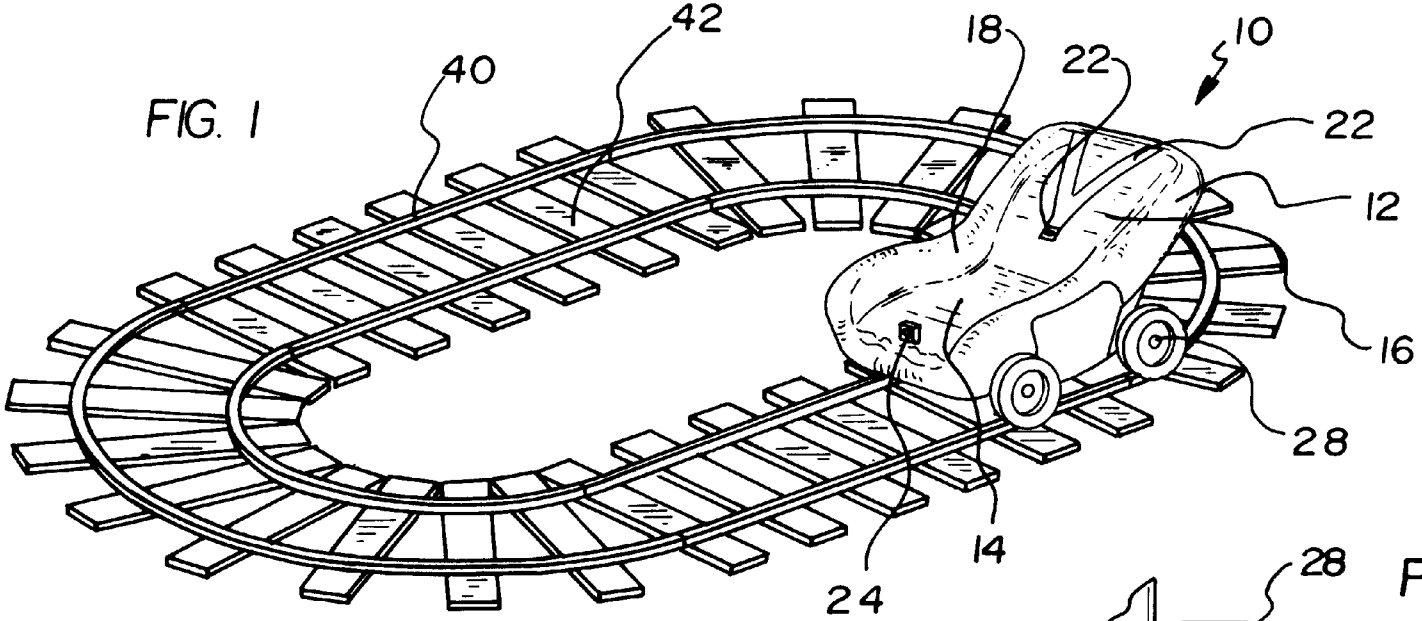
FIG. 1 is a perspective view of a new wheeled child seat with track according to the present invention.

With reference now to the drawings, and in particular to FIGS. 1 through 4 thereof, a new wheeled child seat with track embodying the principles and concepts of the present invention and generally designated by the reference numeral 10 will be described.

The present invention, designated as numeral 10, includes a child seat 12 constructed from a plastic material. The seat includes a bottom 14 and a back 16 integrally coupled to the bottom and extending upwardly and rearwardly therefrom. A pair of peripheral lips 18 are each integrally coupled along side edges of the bottom and back and extended upwardly and outwardly therefrom in perpendicular relationship therewith. A pad lines an upper surface of the bottom, the back and an inner surface of the peripheral lips of the seat.

As shown in FIG. 1, a Y-shaped harness 20 is provided including a pair of upper ends coupled to a top edge of the back of the seat. A lower end of the harness is equipped with a male locking tab 22 for being releasably received within a female slot 24 of a locking mechanism. Such locking mechanism is mounted on a central extent of a front edge of the bottom of the seat. It should be noted that the seat may include seat belt receiving slots such that the seat may be employed in a conventional manner within a vehicle as a child car seat.

Figure 3:
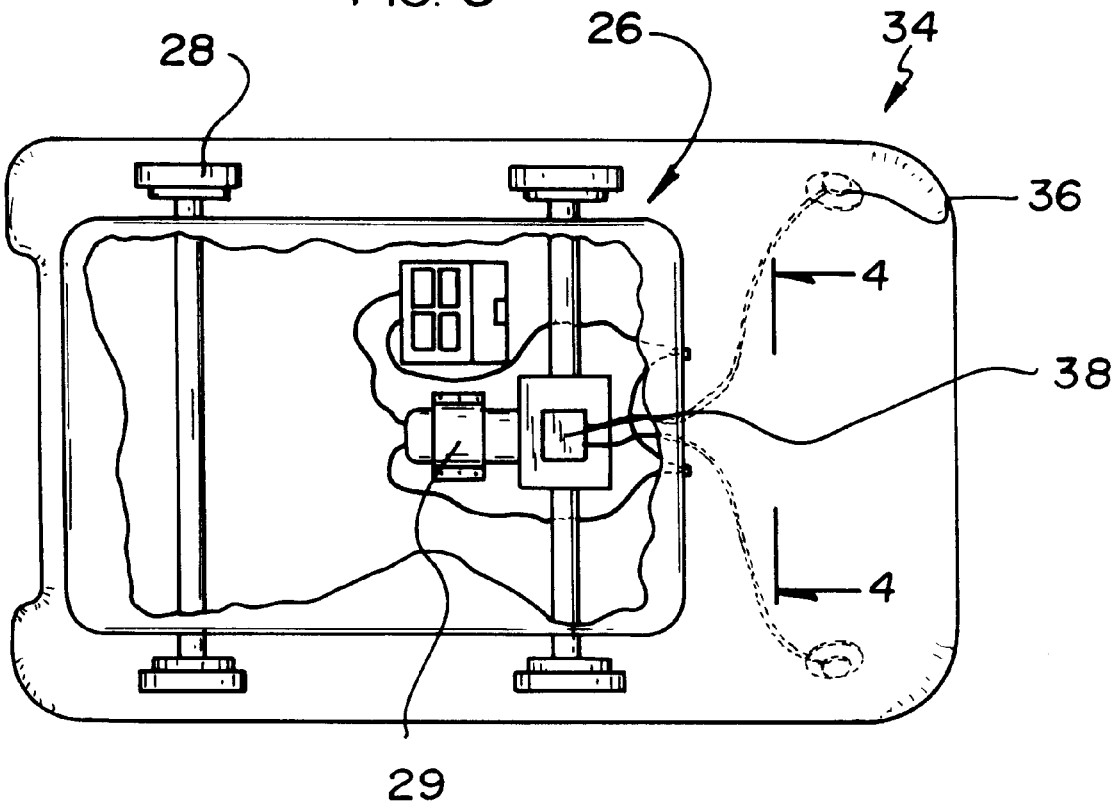
FIG. 3 is a bottom view of the present invention.

With reference now to FIG. 3, a drive assembly 26 includes a pair of axles mounted on a lower surface of the bottom of the seat. Each axle has a pair of disk-shaped wheels 28 coupled to its ends. A motor 30 is coupled to the lower surface of the bottom of the seat and remains in engagement with a rear one of the axles for rotating the wheels upon actuation. The motor may be engaged with the rear axle by way of bevel gears or the like.

Figure 4:
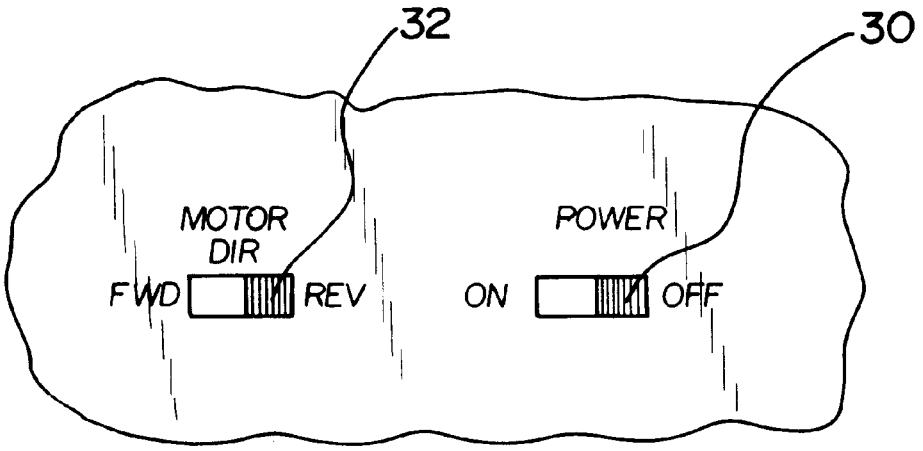
FIG. 4 is an illustration of the power and direction switch of the present invention.

FIG. 4 shows a power slider switch 30 mounted on the seat which is connected between the batteries and the motor. In a first orientation, the power switch serves for actuating the motor. The power switch further deactivates the motor when in a second orientation. Situated adjacent to the power switch is a direction slider switch 32 that is adapted for rotating the wheels in a first direction when the direction switch is in a first orientation and the motor is actuated. The direction switch is further adapted for rotating the wheels in a second direction when the direction switch is in a second orientation and the motor is actuated.

Further included is a sound generating assembly 34 having a pair of speakers 36 each coupled to an upper end of one of the peripheral lips of the seat. Connected to the speakers is a sound module 38 for emitting sound from the speakers only during the actuation of the motor. To accomplish this, the sound module may be connected between the batteries and the power switch. The sound that is emitted preferably simulates a sound of a train or other vehicle.

Figure 2:
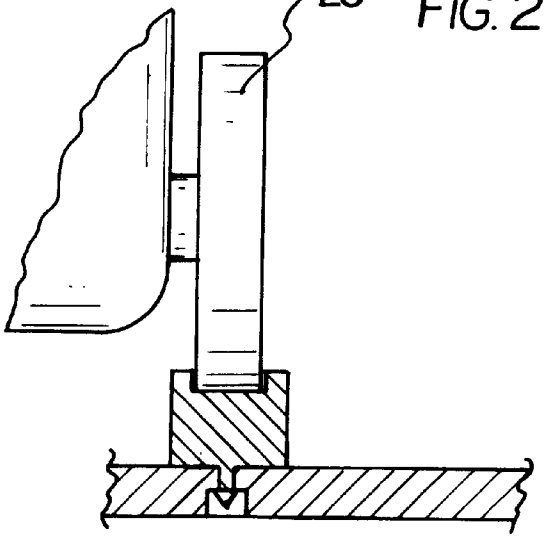
FIG. 2 is a front view of the present invention showing the wheels of the drive assembly situated within the track.

Finally, a track includes a pair of rails 40 interconnected by cross members 42 spaced a foot apart, as shown in FIG. 1. The track includes a pair of parallel linear portions interconnected by way of a pair of semicircular portions, thereby defining an oval configuration. In the preferred embodiment, the various portions of the track are snappily coupled. As shown in FIG. 2, the rails of the track each have a top face with a recess formed therein for receiving the wheels of the drive assembly to maintain such wheels on the track.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A wheeled child seat comprising, in combination:

a child car seat constructed from a plastic material and including a bottom, a back integrally coupled to the bottom and extending upwardly and rearwardly therefrom, a pair of peripheral lips each integrally coupled along side edges of the bottom and back and extending upwardly and outwardly therefrom in perpendicular relationship therewith, a pad lining an upper surface of the bottom, the back and the peripheral lips of the seat, a Y-shaped harness with a pair of upper ends coupled to a top edge of the back of the seat and a lower end with a male locking tab mounted thereon for being releasably received within a female slot of a locking mechanism mounted on a central extent of a front edge of the bottom of the seat;

a drive assembly including a pair of axles mounted on a lower surface of the bottom of the seat each with a pair of disk-shaped wheels coupled to ends thereof, a plurality of batteries mounted on the seat, a motor coupled to the lower surface of the bottom of the seat and remains in engagement with a rear one of the axles for rotating the wheels upon actuation, a power switch mounted on the seat and connected between the batteries and the motor for actuating the same when in a first orientation and further deactivating the same in a second orientation, and a direction switch for rotating the wheels in a first direction when the direction switch is in a first orientation and the motor is actuated and rotating the wheels in a second direction when the direction switch is in a second orientation and the motor is actuated;

a sound generating assembly including a pair of speakers each coupled to an upper end of one of the peripheral lips of the seat and a sound module connected to the speakers for emitting sound from the speakers only during the actuation of the motor, the speakers emitting a simulated sound of a train for helping create a sensation of riding a train; and a track including a pair of rails interconnected by cross members, the track including a pair of parallel linear portions interconnected by way of a pair of semicircular portions, thereby defining an oval configuration, the rails of the track each having a top face with a recess formed therein for receiving the wheels of the drive assembly to maintain the wheels of the drive assembly of the seat on the track;

uppermost portions of each of the rails being positioned below longitudinal axes of the axles of the drive assembly for helping prevent pinching of fingers between the rails and the wheels;

each of the rails having at least one fastening member extending from a lower surface thereof for coupling the rail to a cross member, each of the cross members having a pair of apertures extending therethrough positioned towards opposite ends of the cross member, an upper portion of the aperture having a smaller diameter than a lower portion of the aperture, the fastening members of the rails extending into the apertures of the cross members, flanges at free ends of the fastening portions each having an outer diameter greater than the inner diameter of the associated upper portion of the aperture.

2. A wheeled child seat comprising:

a seat including a bottom, a back integrally coupled to the bottom and extending upwardly therefrom, and a harness for securing a child within the seat;

a Y-shaped harness with a pair of upper ends coupled to a top edge of the back of the seat and a lower end with a male locking tab mounted thereon for being releasably received within a female slot of a locking mechanism mounted on a central extent of a front edge of the bottom of the seat;

a drive assembly including wheels mounted on the seat, a plurality of batteries mounted on the seat, a motor coupled to the seat and in communication with the wheels for rotating the same upon actuation; and a track including a pair of rails, the wheels engaging the rails, uppermost portions of each of the rails being positioned below radial axes of the wheels of the drive assembly for helping prevent pinching of fingers between the rails and the wheels.

3. A wheeled child seat as set forth in claim 2 wherein the seat is padded and includes a peripheral lip.

4. A wheeled child seat as set forth in claim 2 wherein the seat is a car seat adapted to be secured on a vehicle seat by way of a seat belt.

5. A wheeled child seat as set forth in claim 2 and further including a sound generating assembly adapted to emit sound only upon the actuation of the motor.

6. A wheeled child seat as set forth in claim 2 and further including a track along which the seat is adapted to move.

7. A wheeled child seat as set forth in claim 6 wherein the motor is adapted to move the seat on the track in a first direction and a second direction.

* * * * *